US006247183B1

(12) United States Patent
Haas-Laursen

(10) Patent No.: US 6,247,183 B1
(45) Date of Patent: Jun. 19, 2001

(54) SECURED INFANT SOCKS

(76) Inventor: Danielle Haas-Laursen, 77-E Escondido Village, Stanford, CA (US) 94305

( * ) Notice: Subject to any disclaimer, the term of this patent is extended or adjusted under 35 U.S.C. 154(b) by 0 days.

(21) Appl. No.: 09/548,327

(22) Filed: Apr. 12, 2000

(51) Int. Cl.[7] ..... A41B 11/00
(52) U.S. Cl. ..... 2/239; 2/80
(58) Field of Search ..... 2/239, 240, 80, 2/241, 83, 75, 160, 409

(56) References Cited

U.S. PATENT DOCUMENTS

| | | | | |
|---|---|---|---|---|
| 1,119,930 | * | 12/1914 | Decker | 2/239 |
| 1,189,665 | * | 7/1916 | Clear et al. | 2/239 |
| 1,256,444 | * | 2/1918 | Derritt | 2/239 |
| 1,833,163 | * | 11/1931 | Ischinger | 2/239 |
| 3,555,567 | * | 1/1971 | Owen | 2/69 |
| 5,579,541 | * | 12/1996 | Christy et al. | 2/239 |
| 5,740,558 | * | 4/1998 | Messman | 2/239 |
| 5,918,318 | * | 7/1999 | Jones | 2/239 |
| 6,032,294 | * | 3/2000 | Dean | 2/239 |

* cited by examiner

*Primary Examiner*—Gloria M. Hale
(74) *Attorney, Agent, or Firm*—Thelen Reid & Priest LLP; David B. Ritchie

(57) ABSTRACT

An infant sock capable of being securely attached to an infant's clothing to prevent loss includes a piece of material that extends past the cuff of the sock and is fastened to the infant's clothing in one of several ways. When infant clothing is selected that has snaps for easy diaper access, then the present invention makes use of these snaps for securing the material. One way to attach the sock is to shape the material extension into a loop and place the loop around the snap on the inside leg of the infant's clothing such that the male and female members of the snap are closed and the loop is securely sandwiched between the snap. Alternatively, the piece of material extension can be fitted with a male and female member of a snap sewn on opposite sides. These snap members are then secured to the infant garment by mating the snaps from the garment with the snaps of the sock extension. When infant clothing lacks the snap ensemble for easy diapering, an extra attachment, consisting of piece of material with a clip on one end, is looped through the sock loop and then attached to the garment via the clip.

11 Claims, 4 Drawing Sheets

SECURED INFANT SOCKS

BACKGROUND OF THE INVENTION

1. Field of the Invention

The present invention relates to the field of footwear. More particularly, this invention relates to infant footwear that attaches to clothing, thus preventing it from falling off a baby's foot and becoming lost.

2. The Background

It is important for infants to wear socks or booties in order to maintain body temperature, as feet are one of the primary ports through which heat escapes. Additionally, from an economic standpoint, it is expensive to lose an infant's socks.

FIG. 1 is a diagram depicting a typical infant sock. It is similar to most adult socks, sized proportionately. However, infant socks are lost easily in a number of ways. One common way to lose the socks is by taking babies in and out of car seats, strollers, swings, carriers and the like. These all have some type of harness to protect the baby, which generally consists of at least one part that fits between a baby's legs. As the baby's legs are taken in and out, it is easy for a sock to fall off of the baby's foot either from catching on the harness or from being pushed into a place that is not a well fitting part of the foot. Babies also squirm, kick, roll, and crawl during various development stages, and all of this motion tends to push the socks off feet. An additional way in which socks are lost is around four to eight months, babies "discover" their feet. Babies become fascinated by their own feet and do such things as pull off their own socks, put their toes in their mouths, and generally pull on their feet and toes. One can imagine how once these socks are pulled off, they are discarded wherever the baby may be, including the mall, the playground, the street, etc. Unless a parent or caregiver happens to notice, the sock is then lost.

Houghteling in U.S. Pat. No. 4,976,050 attempted to deal with this by inventing an elastic strap with a snap on either side that fits around the baby's ankle. While this is one way to approach the problem, it has several drawbacks. One is that if the elastic does not fit tightly enough around the ankle, it is still easy to loose getting in and out of various baby apparatus and in the other ways discussed above. However, if the elastic is too tight, then the infant's circulation could be compromised. Finding this delicate balance is a challenge and what may work for the baby at three months may be too tight at five months or too loose at one month. Thus, the sock may only work in peak performance for a limited window of time.

What is needed is a sock that is able to grow with the baby for a number of months and has the capability of not being lost from the child's person.

SUMMARY OF THE INVENTION

A piece of material is added to the traditional baby sock or bootie, with the added material located on the cuff of each sock. This piece of material may be made of elastic, a reasonable strength yarn or fabric, hook and loop type fastener material, or from the sock material itself. This material is then fastened to the infant's clothing in one of several ways. One mechanism for attaching the sock utilizes the snap enclosures that are found on a lot of infant clothing, including pants, jumpers, and overalls. Such snap enclosures are found around the inside pants legs and crotch, making an easy access for diaper changes. The material may be shaped into a loop and fastened to the infant garment by looping it around the male and female parts of the existing garment snap; thus securing the sock. The parent or caregiver dressing the child simply selects the snap at the most comfortable level for the infant at the particular time, and this can be adjusted as the child grows or depending on the fit of the particular outfit. In one specific embodiment the piece of material is sewn into a loop shape. In this case, the loop is simply stretched over the selected snap and then enclosed when the snap is mated. In another specific embodiment the piece of material is placed around the mated snap and then fastened back to the sock itself, creating a loop when it is secured. The piece of material can be fastened into a loop with a snap, a button, a clip, or hook and loop type material. Alternatively, the piece of material may be secured to the infant garment without forming a loop. In this embodiment, a female snap member is sewn onto one side of the material extension and a male snap member is sewn onto the opposite side. These snaps can then be directly snapped into the infant's garment with the garment's existing snaps, such that the piece of material is sandwiched between the garment.

When infant clothing is selected without this snap ensemble, an additional part may be added to the present invention to secure the sock. An extra piece of material with a clip on one end is placed through the sock loop and then fastened to an appropriate part of the baby's clothing.

DETAILED DESCRIPTION OF THE PREFERRED EMBODIMENTS

Those of ordinary skill in the art will realize that the following description of the present invention is illustrative only and not in any way limiting. Other embodiments of the invention will readily suggest themselves to such skilled persons after a perusal of the within disclosure.

Figure 1:
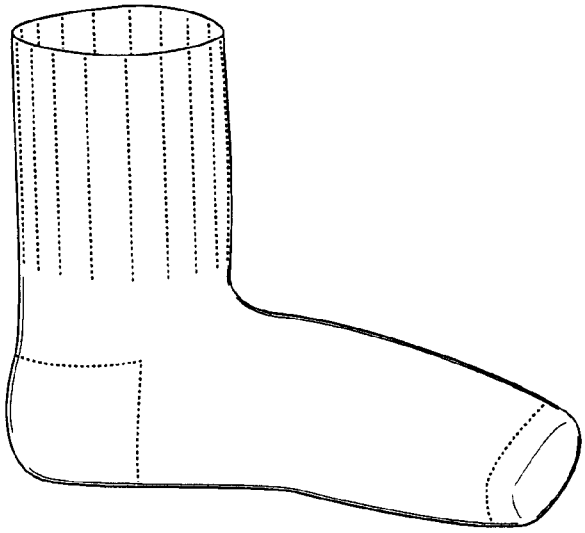
FIG. 1 is a front perspective diagram showing a traditional infant sock or bootie.
Figure 2:
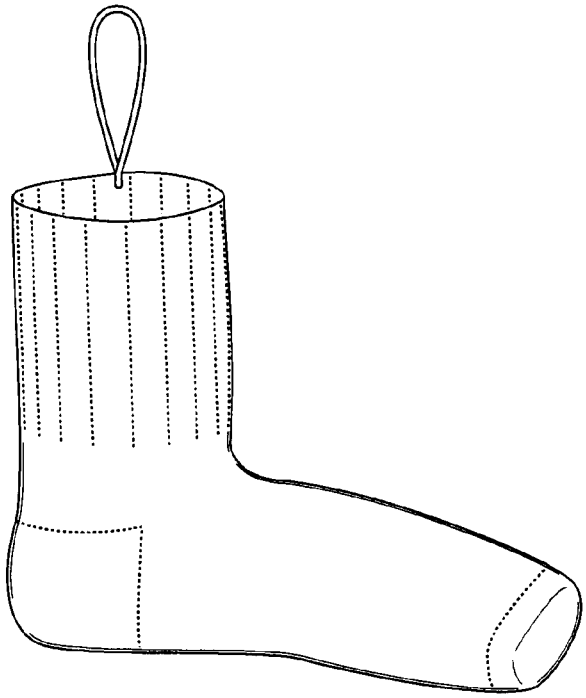
FIG. 2 is a front perspective diagram showing an infant sock with a loop on the inside cuff in accordance with a specific embodiment of the present invention.
Figure 3:
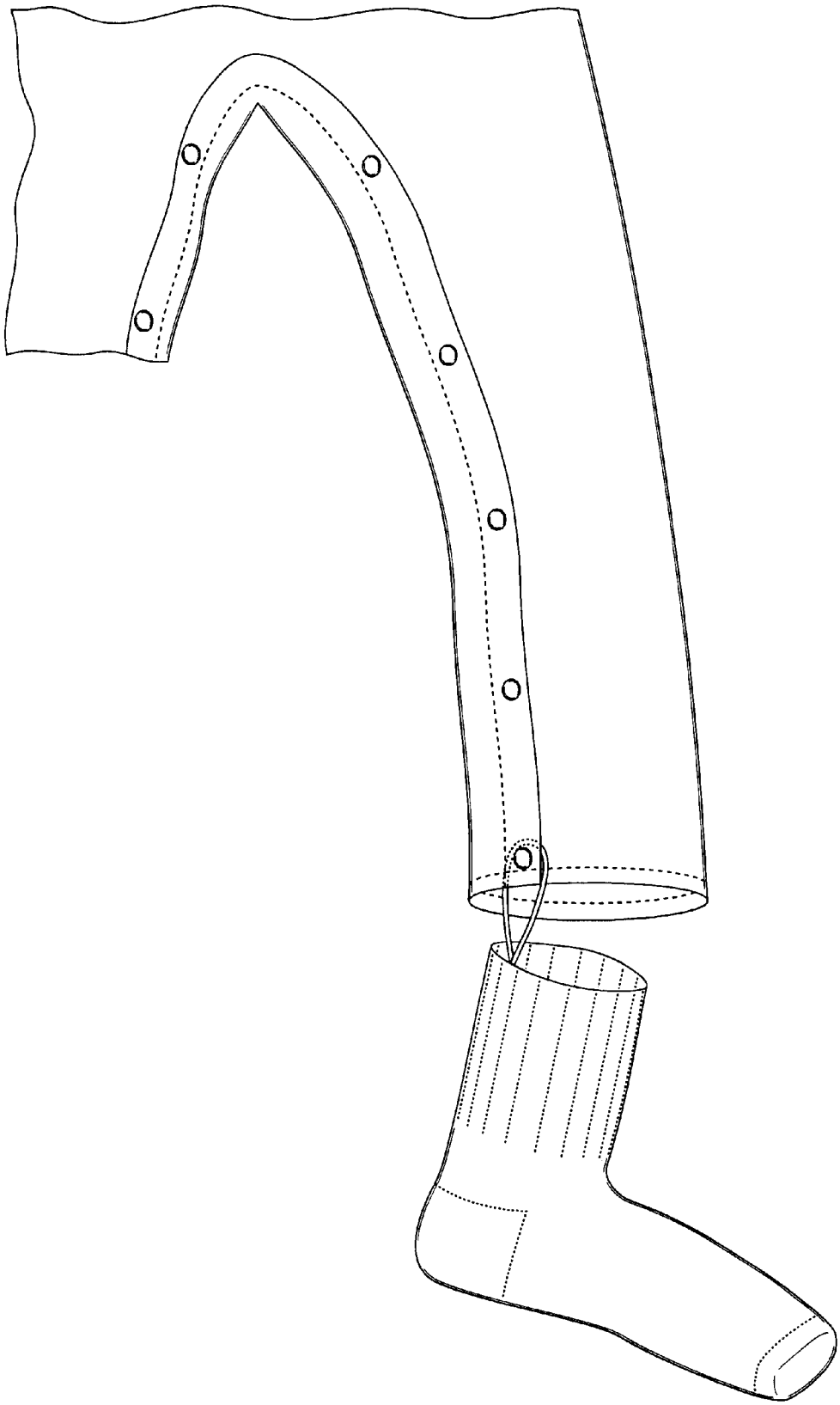
FIG. 3 is a front perspective diagram showing an infant sock with a loop on the inside cuff attached to an infant garment in accordance with a specific embodiment of the present invention.

FIG. 2 is a diagram illustrating of one specific embodiment of the present invention. The traditional infant sock has an additional piece of material preferably located on the interior of the leg side of each sock. This piece of material can then be fastened to an infant's garment in several ways. In one embodiment a loop shape is formed and this loop is secured around the snap enclosures that are typically found on infant's clothing for easy diaper changing. As shown in FIG. 3, the snap at the most comfortable level for the infant at the particular time is selected, and this can be adjusted as the child grows or depending on the fit of the selected outfit. There are several embodiments for the loop. One is to have the piece of material on the sock sewn into a loop shape. In this case, the loop is simply stretched over the selected snap on the infant's garment and then enclosed when the snap is mated. Another embodiment is for the piece of material to be placed around the mated snap on the infant's garment and then fastened back to the sock itself, creating a loop when it is secured to the sock. The piece of material can be fastened into a loop with either a snap, a button, a clip, or hook and loop type material on the infant's sock.

Figure 4:
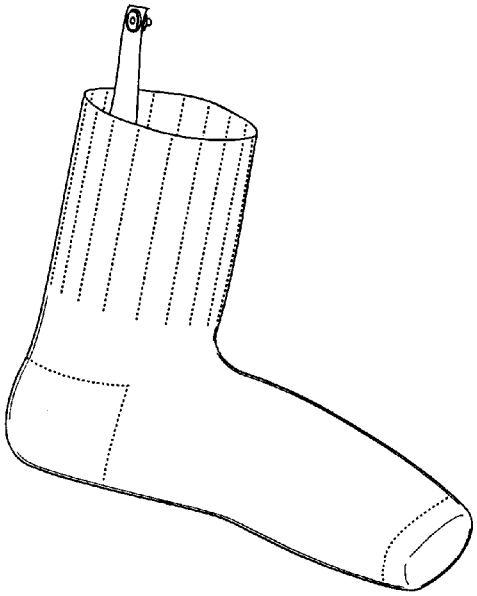
FIG. 4 is a front perspective diagram showing an infant sock with a piece of material extending from the inside cuff with a female snap member on one side and male snap member on the other side in accordance with a specific embodiment of the present invention.
Figure 5:
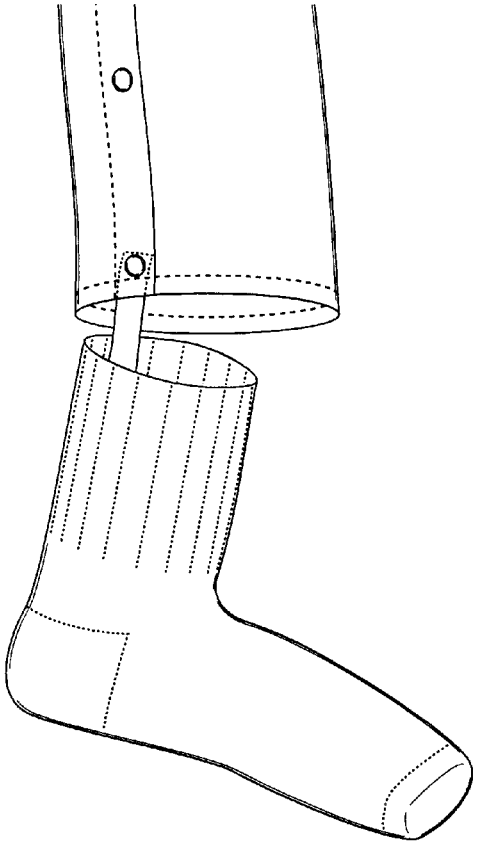
FIG. 5 is a front perspective diagram showing an infant sock with a piece of material extending from the inside cuff with a female snap member on one side and male snap member on the other side attached to an infant garment in accordance with a specific embodiment of the present invention.

An alternative embodiment to secure the sock to infant clothing is to attach the piece of material directly to the garment without forming a loop. As shown in FIG. 4, one side of the material will have a male snap member and the other side will have a female snap member. This material can attach directly into the infant's garment by mating the snaps together, such that the material attachment is sandwiched between the garment. This is illustrated in FIG. 5. As with the loop embodiment, the snap at the most comfortable level for the infant at the particular time is selected, and this can be adjusted as the child grows or depending on the fit of the selected outfit.

Figure 6:
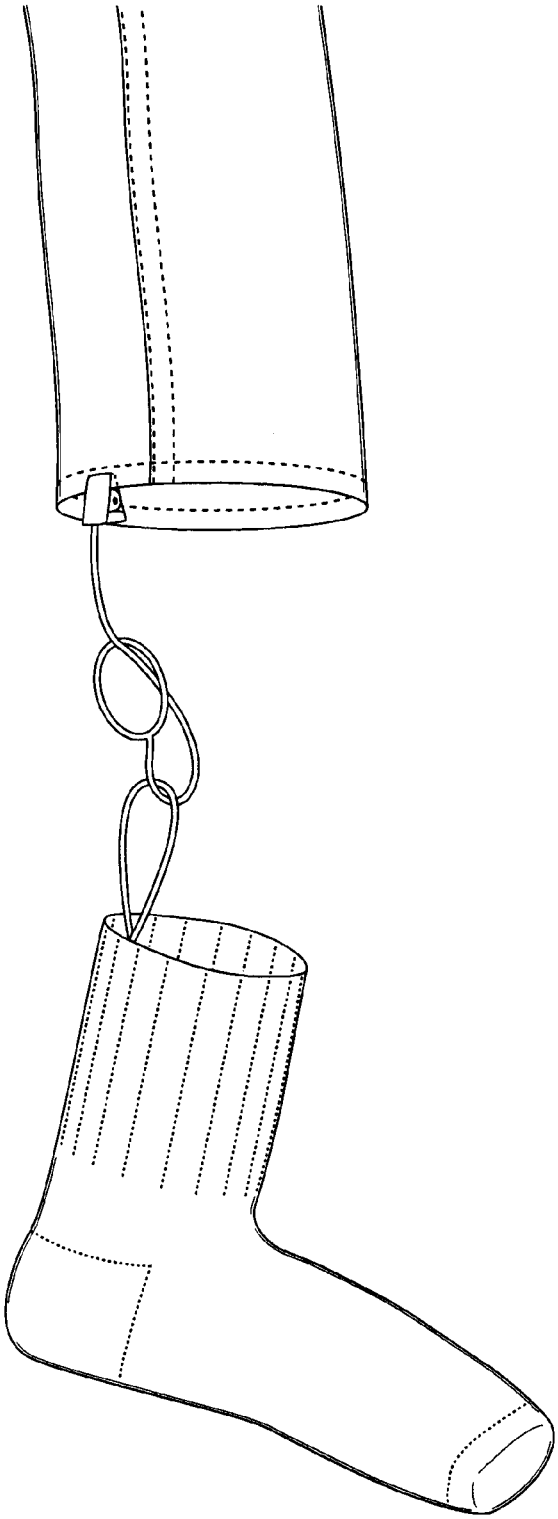
FIG. 6 is a front perspective diagram showing an infant sock with a loop on the inside cuff and an additional attachment of a piece of material with a clip on one end that may be fed through the loop and then clipped to secure the sock in accordance with another specific embodiment of the present invention.

When infant clothing is selected without the snap ensemble for diapering, an additional part may be added to the present invention to secure the sock. As shown in FIG. 6, an extra loop with a clip on one end is placed through the sock loop and then fastened to an appropriate part of the baby's clothing. Thus, the sock is secured to the clothing. Additionally, the place of attachment may change depending on the height of the child or the size of the particular outfit selected.

In the embodiments discussed above, there are several advantages gained from the invention. One is that the socks will remain on the infant's feet during normal wear. In the event that the sock slips from the baby's foot or is pulled off by the baby himself, the sock will remain attached to the clothing. Thus, the economic advantage remains, as the parent or caregiver will not permanently lose the sock and need only reposition it on the foot. Finally, this invention requires little skill or time to secure—only requiring one extra step in the dressing process—making it practical for new parents to utilize.

ALTERNATIVE EMBODIMENTS

While embodiments and applications of the invention have been shown and described, it would be apparent to those of ordinary skill in the art, after a perusal of the within disclosure, that many more modifications than mentioned above are possible without departing from the inventive concepts herein. The invention, therefore, is not to be restricted except in the spirit of the appended claims.

What is claimed is:

1. An infant's sock comprising:

a sock body including a sock cuff;

a piece of material extending from an inner portion of said cuff that is shaped into a first loop, where inner refers to the medial side of a limb of the infant;

a clip attached to a second loop of material, said second loop of material interlocked with said first loop of material.

2. A method of securing an infant's sock against loss, said method comprising:

supplying said sock with a piece of material in the shape of a loop that is disposed from the inner portion of a cuff of said sock, where inner refers to the medial side of a limb of the infant;

securing said loop of material to a portion of clothing worn by the infant.

3. A method of securing an infant's sock against loss, said method comprising:

supplying said sock with piece of material that is disposed from the inner portion of a cuff of said sock, where inner refers to the medial side of a limb of the infant;

supplying a mechanism to secure the piece of material in the shape of a loop;

securing said loop of material to a portion of clothing worn by the infant.

4. A method of securing an infant's sock against loss, said method comprising:

supplying said sock with piece of material that is disposed from a cuff of said sock;

supplying a mechanism to secure the piece of material in the shape of a first loop;

supplying a clip attached to a second loop of material, said second loop of material interlocked with said first loop of material;

securing said second loop of material to a portion of clothing worn by the infant.

5. An infant's sock, comprising:

a sock body including a sock cuff; and a piece of material extending from said the inner portion of said cuff with a male snap on one side and a female snap on the opposite side, where inner refers to the medial side of a limb of the infant.

6. A method of securing an infant's sock against loss, said method comprising:

supplying said sock with a piece of material disposed from the inner portion of a cuff of said sock, where inner refers to the medial side of a limb of the infant;

supplying a male snap on one side and a female snap on the opposite side of said piece of material;

securing said piece of material to an inner portion of clothing worn by the infant by mating the snaps on said piece of material together with snaps provided on a portion of the clothing worn by the infant.

7. An infant's sock, comprising:

a sock body including a sock cuff; and a piece of material extending from an inner portion of said cuff, said inner portion shaped into a first loop, where inner refers to the medial side of a limb of the infant.

8. An infant's sock according to claim 7, wherein said piece of material is sewn into the sock in the shape of said first loop.

9. An infant's sock according to claim 7, wherein said piece of material is secured into the shape of said first loop with a snap on the said cuff.

10. An infant's sock according to claim 7, wherein said piece of material is secured into the shape of said first loop with a button on the said cuff.

11. An infant's sock according to claim 7, wherein said piece of material is secured into the shape of said first loop with releasable hook and loop-type fastening material disposed on said cuff.

* * * * *